US009500067B2

(12) United States Patent
Palka

(10) Patent No.: US 9,500,067 B2
(45) Date of Patent: Nov. 22, 2016

(54) SYSTEM AND METHOD OF IMPROVED FLUID PRODUCTION FROM GASEOUS WELLS

(71) Applicant: Pumpwell Solutions, Ltd., Calgary (CA)

(72) Inventor: Krzysztof Palka, Calgary (CA)

(73) Assignee: Ambyint Inc., Calgary (CA)

( * ) Notice: Subject to any disclaimer, the term of this patent is extended or adjusted under 35 U.S.C. 154(b) by 641 days.

(21) Appl. No.: 13/655,010

(22) Filed: Oct. 18, 2012

(65) Prior Publication Data

US 2013/0277063 A1 Oct. 24, 2013

Related U.S. Application Data

(60) Provisional application No. 61/552,455, filed on Oct. 27, 2011.

(51) Int. Cl.
*E21B 43/12* (2006.01)

(52) U.S. Cl.
CPC ..... *E21B 43/121* (2013.01)

(58) Field of Classification Search
CPC .. E21B 43/121; E21B 43/122; E21B 43/126; E21B 2043/125; E21B 21/14
See application file for complete search history.

(56) References Cited

U.S. PATENT DOCUMENTS 3,797,968 A * 3/1974 Elfarr ..... 417/138
4,111,829 A * 9/1978 Bimond ..... B01D 19/0005 96/176
4,633,954 A * 1/1987 Dixon et al. ..... 166/372
5,735,346 A * 4/1998 Brewer ..... 166/250.03
7,753,115 B2 * 7/2010 Zupanick ..... 166/106
2002/0007953 A1 * 1/2002 Liknes ..... 166/372
2002/0040784 A1 * 4/2002 De Almeida ..... 166/372
2002/0053426 A1 * 5/2002 Kelley ..... E21B 43/121 166/67
2003/0183394 A1 * 10/2003 Reitz ..... 166/370
2004/0060705 A1 * 4/2004 Kelley ..... 166/372
2004/0200615 A1 * 10/2004 Wilde ..... 166/250.15
2009/0145595 A1 * 6/2009 Mazzanti ..... 166/106

OTHER PUBLICATIONS

Dictionary definition of "valve", accessed Mar. 18, 2015 via thefreedictionary.com.*
Schlumberger Oilfield Glossary entry for "artifical lift", accessed Sep. 3, 2015 via www.glossary.oilfield.slb.com.*

* cited by examiner

*Primary Examiner* — Blake Michener
(74) *Attorney, Agent, or Firm* — R. Neil Sudol; Henry D. Coleman

(57) ABSTRACT

A system and method are provided for improving hydrocarbon production from gaseous wells, and in particular improving hydrocarbon production using pumping systems employing artificial lifts. The pumping system of the well is controlled so as to cyclically decrease and increase gas pressure in the casing annulus, thus cyclically decreasing PBHP in response to the decrease in the casing annulus pressure and permitting the PBHP to increase in response to the increase in casing annulus pressure. Production of fluid from the reservoir is therefore increased during the cyclical decrease in casing annulus pressure, and production of fluid from the downhole pump is increased during the cyclical increase in casing annulus pressure. In addition, gas interference due to production of foam in the casing surrounding a downhole pump can be mitigated by forcing liquid from the foam during the period of increased casing annulus pressure.

21 Claims, 5 Drawing Sheets

SYSTEM AND METHOD OF IMPROVED FLUID PRODUCTION FROM GASEOUS WELLS

CROSS-REFERENCE TO RELATED APPLICATIONS

This application claims priority to U.S. Provisional Application No. 61/552,455 filed 27 Oct. 2011, the entirety of which is incorporated herein by reference.

TECHNICAL FIELD

This disclosure is directed to increasing hydrocarbon production from gaseous wells, and in particular to increasing hydrocarbon production using pumping systems employing artificial lift.

DESCRIPTION OF THE RELATED ART

A majority of hydrocarbon producing wells use artificial lift technology to bring fluid extracted from the reservoir to the surface. Artificial lift typically involves a sucker-rod pump (SRP), progressive cavity pump (PCP), electric submersible pump (ESP) or plunger lift (PL). All of these pumping systems have a downhole pump that pushes fluid gathered in the wellbore in an upward direction. The fluid that flows from the reservoir into the wellbore usually consists of liquid (oil and/or water) and gas. In wells with a large gas to oil ratio (GOR), the production of fluid can be limited by gas interference in the pump. Gas interference can occur when the gas liberated from a solution produces foam that occupies a significant volume within the wellbore casing surrounding the downhole pump. When the foam is introduced into the pump it reduces pump fillage, thus limiting the liquid intake volume of the pump.

Fluid flows from the reservoir into the wellbore through perforations in casing or liner, or through sectors of the wellbore without any casing or liner in case of open hole completion. The section of the wellbore between the top and bottom location of fluid inlet is called a producing interval. Gas interference may occur if the downhole pump intake is installed above the producing interval, because when the pump is located below the producing interval, a natural separation of gas from liquid occurs before the liquid enters the pump. The gas in the fluid, being less dense than liquid, is displaced (possibly with some liquid) upward and away from the pump intake, while the liquid tends to travel downward towards the pump intake. However, it is not always possible to place the pump intake below the producing interval. In horizontal wells, for example, the pump intake is typically located above the producing interval; therefore, if a horizontal well is producing a significant amount of gas, the position of the pump will permit more foam and free gas to enter the pump and decrease pumping efficiency.

Gas separators can be used to help reduce gas interference and improve pumping efficiency when the pump is located above the producing interval. However, if a significant volume of foam is present in the annular space inside the casing surrounding the pump, the gas separators may not operate efficiently. Furthermore, due to the limited amount of free space within the casing annulus (i.e., the annular region surrounding the downhole pump and/or tubing containing rod elements connecting the pump to the surface) around the gas separator, the gas separator will only be able to separate a limited capacity of gas volume.

BRIEF DESCRIPTION OF THE DRAWINGS

In drawings which illustrate by way of example only embodiments of the present disclosure.

DETAILED DESCRIPTION

The embodiments described herein provide a means of improving fluid yield of a downhole pumping system in a gaseous well by reducing the impact of gas interference on pump efficiency. The proposed solution may be employed in horizontal wells, thus accommodating arrangements where the pump intake is positioned above the producing interval.

Figure 1:
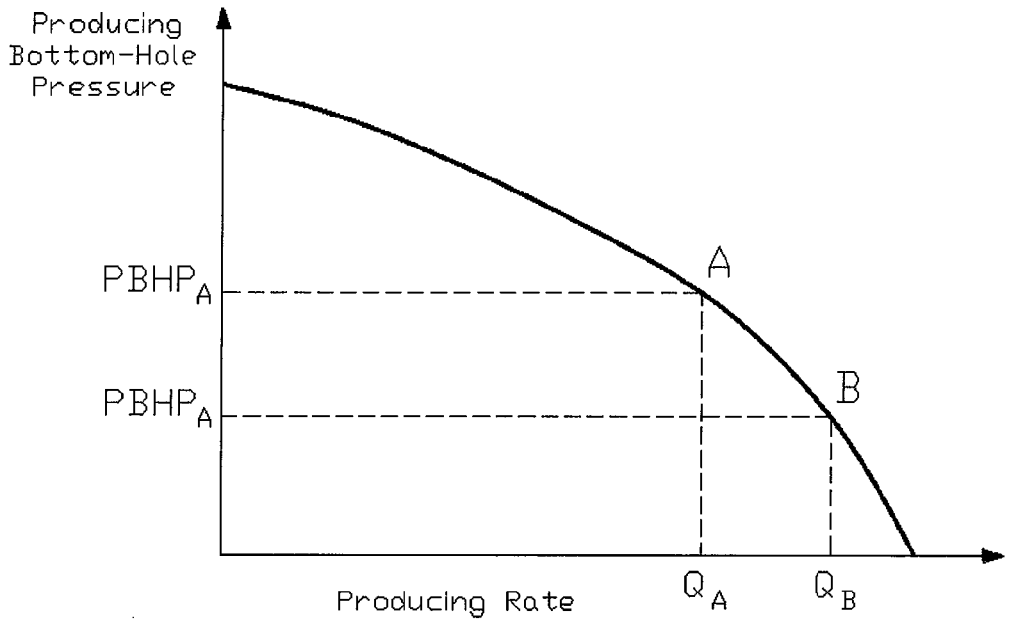
FIG. 1 is an Inflow Performance Relationship (IPR) graph illustrating the relationship between Producing Bottom-Hole Pressure (PBHP) and reservoir output of a well.

In a downhole pumping system in a gaseous well, a lower pump intake pressure will result in more gas separating from the solution at the pump intake level, producing foam and interfering with fluid intake. Thus, for wells with high gas production, the intake pressure must be maintained above a certain level to limit the amount of free gas entering the pump in the form of foam. However, higher intake pressure adversely affects extraction of fluid from the reservoir into the wellbore because the pump intake pressure is directly related to the Producing Bottom-Hole Pressure (PBHP), i.e., the pressure in the wellbore at the producing interval. Fluid production of the well depends on PBHP because the larger the pressure differential between the reservoir and the wellbore at the producing interval, the more fluid flows from the reservoir to the wellbore. This phenomenon can be appreciated through analysis of the theoretical relationship between PBHP and production rate described by the so-called Inflow Performance Relationship (IPR) curve, first published in "Inflow Performance Relationship for Solution-Gas Drive Wells", Vogel, J. V., Journal of Petroleum Technology, January 1968. The IPR curve applies to stable conditions, when all the currently produced fluid from the reservoir is being pumped to the surface, which means that the fluid level in the casing as well as the PBHP remain fairly constant. The IPR curve can be used to determine fluid production based on the PBHP and vice versa: generally, the lower the PBHP, the greater the expected fluid production from the reservoir, and the greater the PBHP, the lower the expected production. An example of the IPR curve is illustrated in FIG. 1.

The pump intake pressure has a substantially constant offset with respect to the PBHP equal to the pressure of the column of fluid in the casing annulus between the producing interval and the pump intake. Therefore, the relationship between production and pump intake pressure is similar to the relationship between production and the PBHP. Consequently, the fluid production from the reservoir is limited by the minimum pump intake pressure required to prevent excessive release of free gas at the pump intake, and the minimum pump intake pressure can be correlated to a minimum PBHP value (as well as to a minimum fluid level in casing).

Conventionally, during pumping operations the casing pressure control valve remains open and gas flows from the casing to the flowline through the check valve. As a result, casing pressure is typically higher than the flowline pressure. Since the flowline pressure does not undergo significant change, the foam level in the casing is fairly stable as long as the reservoir production rate is fairly stable, resulting in a stable PHBP. When the pump intake pressure is significantly above zero (e.g., significantly above atmospheric pressure), the foam residing in the casing annulus above the pump intake will usually contain a substantial amount of liquid. If that liquid can be effectively produced in order to lower PBHP, then the inflow of fluid from the reservoir will increase, and the efficiency of the pumping system may significantly improve. Further, if the average PBHP can be lowered on a temporary basis, reservoir production can be stimulated, resulting in a surging of inflow fluid from the reservoir into the wellbore and consequently increased pump intake.

Therefore, the present embodiments operate to cycle the pressure in the casing annulus (for example, by opening and closing valve in fluid communication with the casing annulus, such as the casing pressure control valve, i.e., the main valve at the surface located between the casing annulus and the flowline, or a flowline pressure valve) so as to improve average production of fluid from the reservoir as well as production of liquid from foam accumulated in the casing annulus. As a result of the pressure cycling described below, liquid in the form of foam accumulates in the casing annulus during a period of lower PBHP, and then is expressed from the foam into the pump intake. The cycling of pressure in the casing annulus periodically increases PBHP, allowing liquids to accumulate in the column of foam for better pump fillage. The periodic decrease in PBHP stimulates a surge of fluid from the reservoir. The cycling thus assists in maximizing fluid production by improving pump fillage and increasing longevity of the pump.

Figure 2:
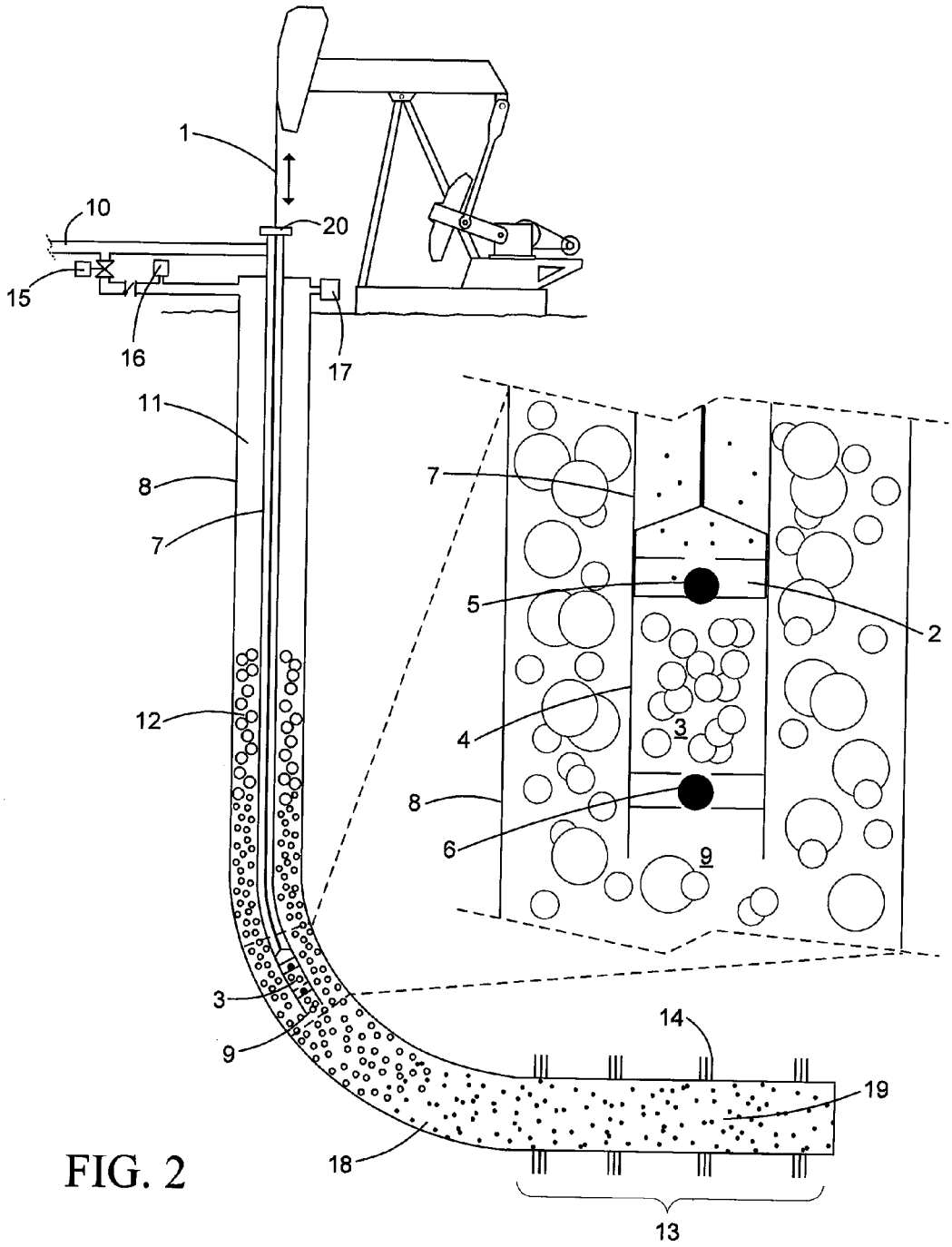
FIG. 2 is a schematic diagram of a horizontal well and a downhole pumping system.

FIG. 2 illustrates a schematic diagram of a well using an artificial lift to produce hydrocarbons in a form of fluid carrying solution gas and/or free gas. The configuration of an artificial lift system will be known to those skilled in the art; briefly, however, in this embodiment, the artificial lift involves a sucker rod pump that consists of a rod string 1 attached at its bottom to the plunger 2 of a downhole pump 3. The top of the rod string 1 undergoes a reciprocal movement that is transferred to the plunger 2, which moves up and down the barrel 4 of the pump 3 causing a sequential opening and closing of the traveling valve 5 and the standing valve 6. The sucker rod 1 moves inside a tubing 7 which in turn is mounted inside casing 8 lining the wellbore 18 leading to the reservoir (not shown). The fluid with gas at the pump intake 9 is sucked into the pump barrel 4 and transferred to the surface inside the tubing 7. Both casing 8 and tubing 7 are connected at the surface to the flowline 10 that further transfers the fluid with gas to a tank or other receiving facility. When the well is flowing on its own, some fluid can also be produced through casing 8. The space inside the casing 8 and the outside of tubing 7 is referred to as the casing annulus 11. The lowest or furthest portion of the casing 8, beyond the tubing, fills with fluid 12 up to at least the level of the pump intake 9. When a significant amount of gas is produced, the fluid often turns into foam. The example well of FIG. 2 is of a horizontal type, since there is a horizontal portion 13 in the wellbore 18 and the casing 8, and the producing interval 19, which includes the portion of the wellbore 18 in having casing perforations 14 communicating with the reservoir, are provided in the horizontal portion 13. In a horizontal type well, the pump intake 9 is therefore always located above the level of the producing interval 19, as shown in FIG. 2. It will be appreciated by those skilled in the art, however, that the pump intake 9 of the downhole pump 3 may be similarly situated with respect to the producing interval 19 in other well configurations.

To improve production, a cyclic increase and decrease in pressure is introduced, either manually or automatically, in the casing annulus 11. In one embodiment, the casing pressure is controlled by opening and closing the casing pressure control valve 15 located at the top of the casing annulus 11. Casing pressure may be monitored by a casing pressure transducer 16 installed on the flowline 10 between the wellhead 20 and the valve 15. Optionally, an acoustic gun 17 can be installed on the wellhead to measure the fluid level in the casing annulus, which allows for estimation of PBHP.

Figure 3:
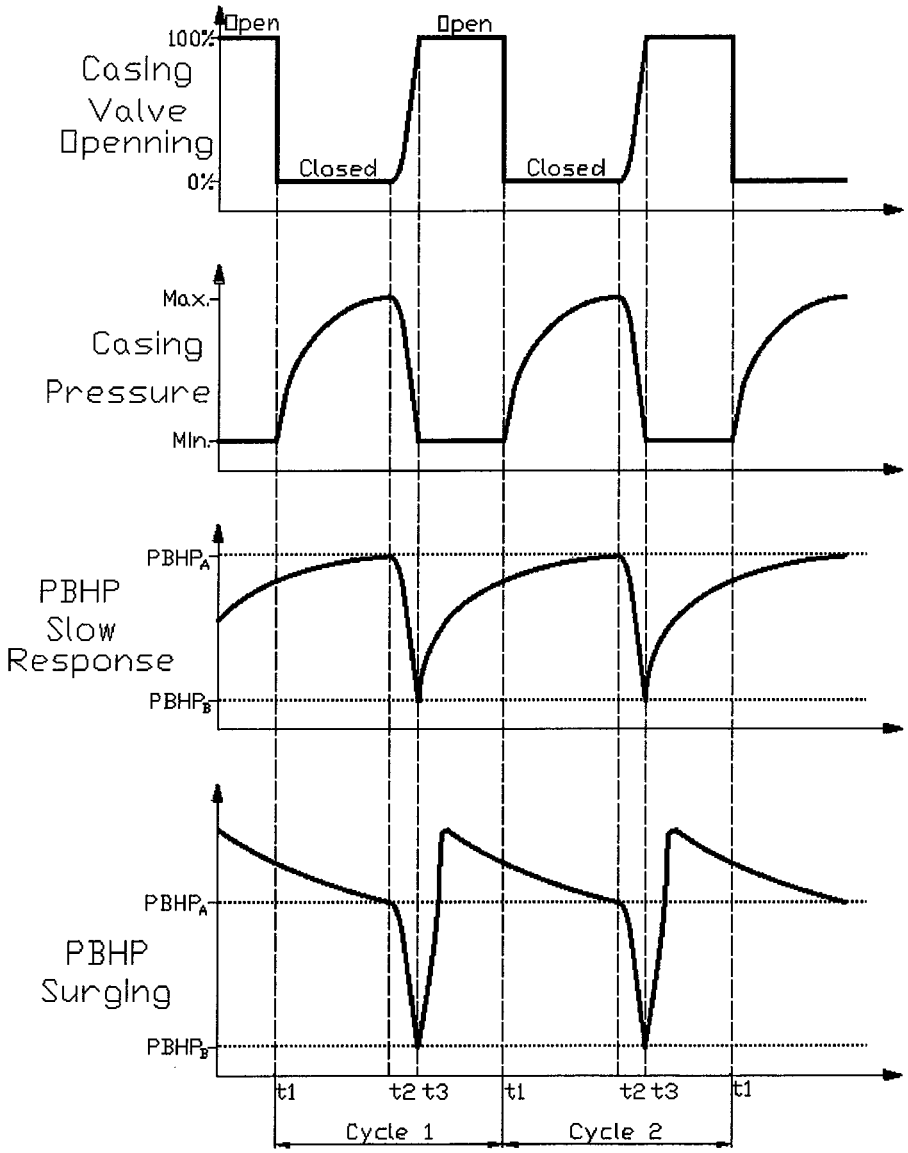
FIG. 3 is a series of graphs illustrating an exemplary relationship between casing valve opening (measured in percent), casing pressure and Producing Bottom-Hole Pressure (PBHP), both slow response and surging, over a period of two pressure cycles.

FIG. 3 illustrates the effects of periodic casing pressure control valve 15 opening and closing on various pressure measurements as a function of time over two consecutive cycles. The graphs of FIG. 3 represent only exemplary pressure cycles, and are not plotted to scale. The first plot illustrates the cycling of opening and closing of the casing pressure control valve 15, represented as a percentage of full opening (0 means completely closed valve, 100% means fully open). The valve 15 is completely closed at time $t_1$ and remains closed until $t_2$, at which point opening of the valve is initiated until fully open at $t_3$. The valve remains open for the duration of the cycle, at which point it is closed again starting at $t_1$. The cycle then repeats. The second plot shows the corresponding relative pressure within the casing annulus 11 over the two cycles. At time $t_1$, the casing pressure is shown to start at a baseline minimum pressure, which increases during the period $t_1$ to $t_2$ while the valve 15 is closed. Upon the opening of the valve 15, the pressure in the casing annulus 11 drops to the minimum pressure by time $t_3$ and remains at that level until the valve is closed again at the beginning of the next cycle at the next $t_1$. The third and fourth plots, PBHP Slow Response and PBHP Surging, illustrate the estimated PBHP during the same period for two different cases of reservoir response to the casing pressure changes. At the beginning $t_1$ of the cycle 1, when fluid and/or foam levels are fairly stable, the casing pressure control valve 15 changes position from fully open to fully closed. This will increase the pressure of the gas above the fluid level in the casing annulus 11 between $t_1$ and $t_2$, as shown in the Casing Pressure plot above. This in turn results in a reduction in the volume of foam in the casing annulus 11 and the forcing of fluid 12 in the casing annulus 11 into the pump 3. The fluid 12 pushed down the casing 8 and into the pump 3 will be of increased density and will contain liquid with the solution gas, but no free gas that will travel in the upward direction. This fluid will be mixed with the liquid and gas coming from the reservoir and will increase the ratio of liquid to gas in the fluid at the point where it enters the pump intake. Since more fluid and less foam will be entering the pump, pump fillage is improved and the amount of fluid produced through the tubing 7 at the surface is increased. Thus, even under a constant reservoir output condition (i.e., production of fluid from the reservoir into the wellbore), an increase in downhole pump production will be realized over the time interval from $t_1$ to $t_2$ when the casing valve is closed.

As those skilled in the art will appreciate, overall reservoir output will also increase as a result of the casing annulus pressure cycling, as compared to the reservoir output that would be experienced under typical stable conditions during the period from $t_2$ to $t_3$ when the casing pressure control valve 15 is open. This additional increase in production is attributable to a lower average PBHP over the entire pressure cycle as compared to the average PBHP under those stable conditions. The typical PBHP under stable conditions is indicated in the PBHP plots in FIG. 3 as $PBHP_A$.

All other conditions being substantially constant, the reduced average PBHP resulting from the casing annulus pressure cycle described above is due mainly to the casing pressure drop once the casing valve 15 is opened at time $t_2$. At that time the casing pressure is much higher than the flowline pressure, therefore the pressure differential causes a high flow rate of gas from the casing 8 to the flowline 10. As a result, the (free) gas accumulated in the casing annulus undergoes fairly quick decompression and flows into the flowline in a relatively short time period from $t_2$ to $t_3$. The casing pressure quickly returns to the minimum value, but due to a limited flow rate of the fluid from the reservoir to the wellbore the fluid fills in the casing annulus at a fairly slow rate. At time $t_3$ the fluid level is still low, close to the pump intake, but the pressure of gas column in the casing annulus already returned to the minimum value (close to the flowline pressure). As a result, the PBHP, being the sum of the pressure of the fluid and gas columns in the casing annulus drops at time $t_3$ to a minimum level $PBHP_B$, as indicated in the Slow Response and Surging plots in FIG. 3. $PBHP_B$ is less than $PBHP_A$ at stable conditions because the fluid level in the casing at time $t_3$ is lower than the fluid level in the case of pumping at a stable condition (i.e., with the average $PBHP_A$ pressure), while the gas pressure will be similar in both the cyclic pressure system described above and the stable system. Once the valve 15 reaches its maximum opening at time $t_3$, the pressure in the casing stabilizes to a minimum value that will be close to the flowline pressure.

While the casing pressure is stabilized after $t_3$, the PBHP gradually increases towards the stable condition value $PBHP_A$ as the fluid level increases, filling the casing annulus. In both the Slow Response and Surging scenarios, the rate of increase of the PBHP is greatest at and shortly after time $t_3$: since the PBHP starts from its lowest level, the reservoir output will be the highest in the cycle, and the fluid from the reservoir will fill the casing annulus at the highest rate in the cycle of the system, as described by the IPR curve. The rate of increase of PBHP decreases as the value approaches $PBHP_A$ as a result of the lower pressure differential between the current PBHP and reservoir pressure. After closing the valve at time $t_1$ of the next cycle, the PBHP could even exceed $PBHP_A$ if the valve remains closed long enough. However, there is no sudden increase of PBHP in the Slow Response scenario, because the increase of the gas column pressure from time $t_1$ to $t_2$ is partially offset by the decrease in the height of the liquid/foam column in the casing annulus 11.

The Slow Response behaviour is illustrated in the third plot of FIG. 3. The average PBHP, as mentioned above, lies somewhere between $PBHP_A$ and $PBHP_B$, where the minimum pressure $PBHP_B$ during the cyclic mode described above is lower than the constant pressure $PBHP_A$ under stable operation with the valve 15 left open. Referring to FIG. 1, the IPR curve shows that the reservoir output production $Q_B$ at pressure $PBHP_B$ is higher than the output $Q_A$ at pressure $PBHP_A$; therefore, the average reservoir output over a cycle will be greater than $Q_A$, lying between $Q_A$ and $Q_B$.

The scenario of a surging response is illustrated in the fourth plot of FIG. 3. In this case, the average PBHP may not necessary be lower than $PBHP_A$. However, the pressure cycling may still realize an increased reservoir output despite the higher average PBHP. With the surging response, the reservoir suddenly increases production while there is a sudden drop in PBHP resulting in higher fluid levels than during stable operation. During this transitory period, the relationship between PHBP and reservoir production rate does not follow the stable-condition IPR curve. Moreover, the well may also start to flow on its own, resulting in additional increase of fluid production through the tubing 7 and even the casing 8.

After the period of valve 15 closure from $t_1$ to $t_2$, it is recommended that the valve 15 be opened before all fluid is pushed out of the casing annulus into the tubing 7 in order to avoid fluid pounding in the pump barrel due to incomplete pump fillage. In that case, opening the valve 15 over the time interval $t_2$ to $t_3$ should be gradual enough to mitigate the cooling effect of gas undergoing decompression while flowing from the casing 8 to the flowline. Excessive cooling of the gas should be avoided as it can cause the formation of hydrates that could plug the flowline. In one embodiment, the decompressing gas is diverted to a container where it is mixed with a flow of warm fluid.

On the other hand, the opening of the casing pressure control valve 15 should not be slower than necessary, since it is also desirable for the PBHP to drop as fast as possible in order to increase the fluid flow from the reservoir (as shown on the plot of PBHP Slow Response in FIG. 3) and ideally cause a surging response that may result in the well flowing on its own for some time; a surging response has the added benefit of cleaning debris caused by fracturing sand and/or scale out of the producing interval 19.

Opening the casing pressure control valve 15 will cause a fast drop in the gas pressure in the casing, while the fluid level will not increase too quickly due to a limited supply of liquid from the reservoir. As a result, the PBHP will drop quickly resulting in increased production of fluid from the reservoir. A greater pressure drop and a shorter time interval of pressure drop during valve opening will cause a larger surge of fluid flow from the reservoir. In some cases, the surge may be so large that the well might start flowing on its own, producing gas with liquid through the casing. The increased fluid production from the reservoir will eventually cause the fluid to gradually fill the casing again to approximately the same level as at the start of the pressure cycle (or higher, in the case of a surging response). Once the casing pressure equalizes with the flowline pressure, the fluid level in the casing will eventually return to its condition prior to the closure of the valve at $t_1$ (provided sufficient time is allowed after the valve opening). This process may then be repeated, starting with closure of the casing pressure control valve 15.

The net result of the pressure cycle is increased production from the well as additional fluid flows from the reservoir during the period of reduced PBHP. This additional fluid is pumped to the surface due to improved pump fillage, mainly during those periods of increased casing annulus pressure, and in the case of a surging response, during the initial period after the surge due to the temporary above average pump intake pressure and improved pump fillage. It will be appreciated that the pressure cycling process effectively provides the benefit of a gas separator, without requiring any additional downhole components as might be required in providing a gas separator, and operating on a different principle. Conventional gas separators accumulate liquid as it moves downwards under the effect of gravity, while gas contained in the fluid travels upwards. The pressure cycling process, on the other hand, separates liquid from gas by forcing the liquid to flow downward due to increased gas pressure above the fluid.

It will be readily appreciated by those skilled in the art that the plots in FIG. 3 are illustrative and exemplary only, and that in the field variations in the measured pressures and in the timing of opening and closing the valve are to be expected, according to the current operating conditions of the well and characteristics of the reservoir. For example, the valve closing at $t_1$, for example, is expected to take a short but non-zero period of time, but this detail has been omitted for ease of illustration.

Figure 4:
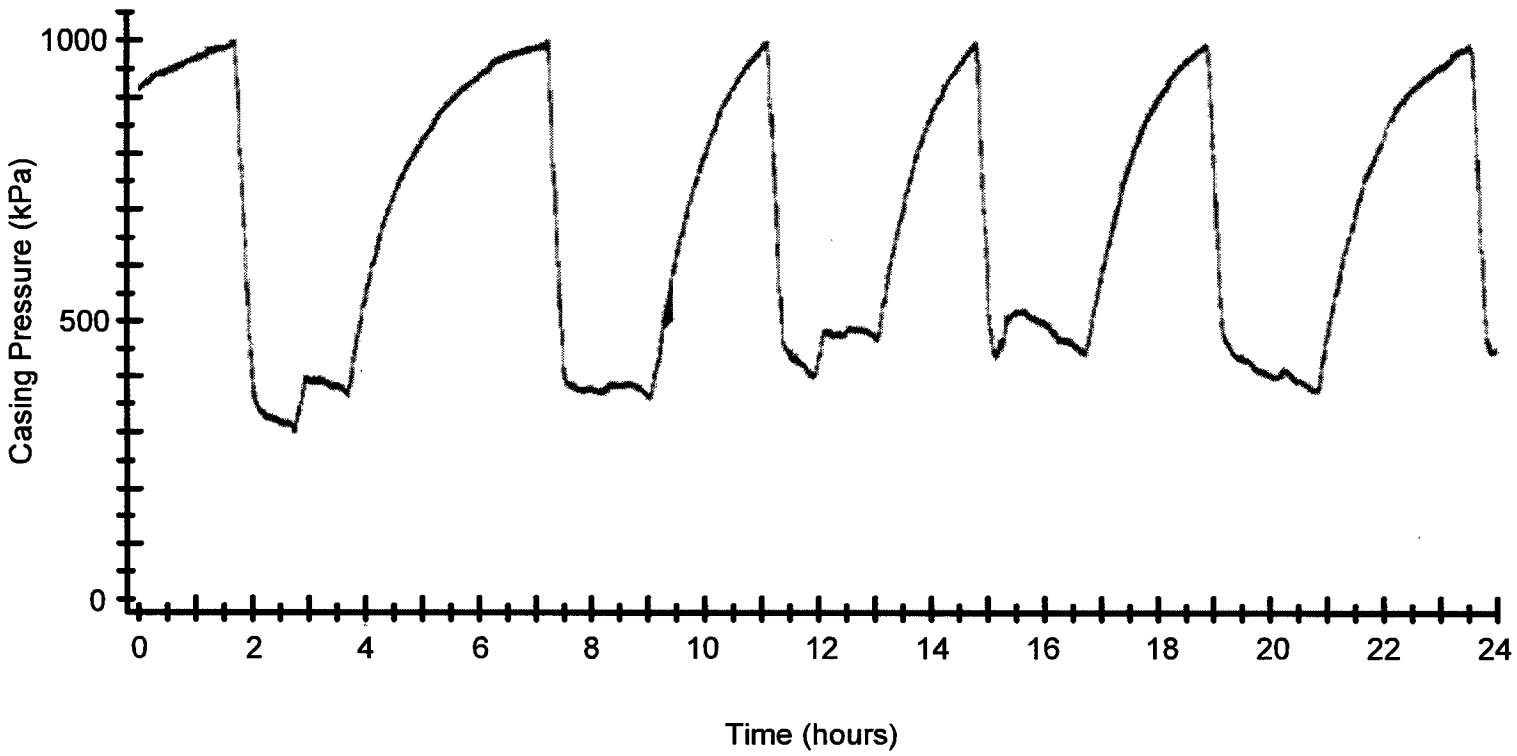
FIG. 4 is a graph illustrating measured casing pressure plotted against time.

FIG. 4 shows a plot of field measurements illustrating casing pressure response to the pressure cycling described above, through the periodic closing and opening of the casing pressure control valve 15 of an actual well over 24 hour duration. During the 24 hours, the valve 15 was closed five times (two of these instances are marked as $t_1$ in FIG. 4), and opened six times (one of these instances is marked as symbol $t_2$). It can be seen that the change in pressure over time resembles the expected casing pressure response pattern illustrated in the second plot of FIG. 3. The casing valve was opened at time $t_2$ when it was determined that the casing pressure increase had started to taper off (i.e., approached a substantially stable level) after closure of the valve 15 at $t_1$, approximately three hours after a steep casing pressure climb following the closure. At this point the casing pressure may be substantially equal to the flowline pressure. The threshold pressure used to determine time $t_2$ (in this case, 1000 kPa) was established during a previous cycle, and was used thereafter to determine the time to open the valve during subsequent cycles. The valve was closed again at time $t_1$, about 1.75 hours after its opening, when it was determined that the fluid level had lowered to be substantially close to the pump intake. That determination was also carried out during one of the previous cycles, based on a calculation of the so-called "downhole card" indicating pump-off conditions, as described for example in "Sucker-rod pumping manual" by G. Takacs, PennWell Books, Oklahoma, 2003.

Figure 5:
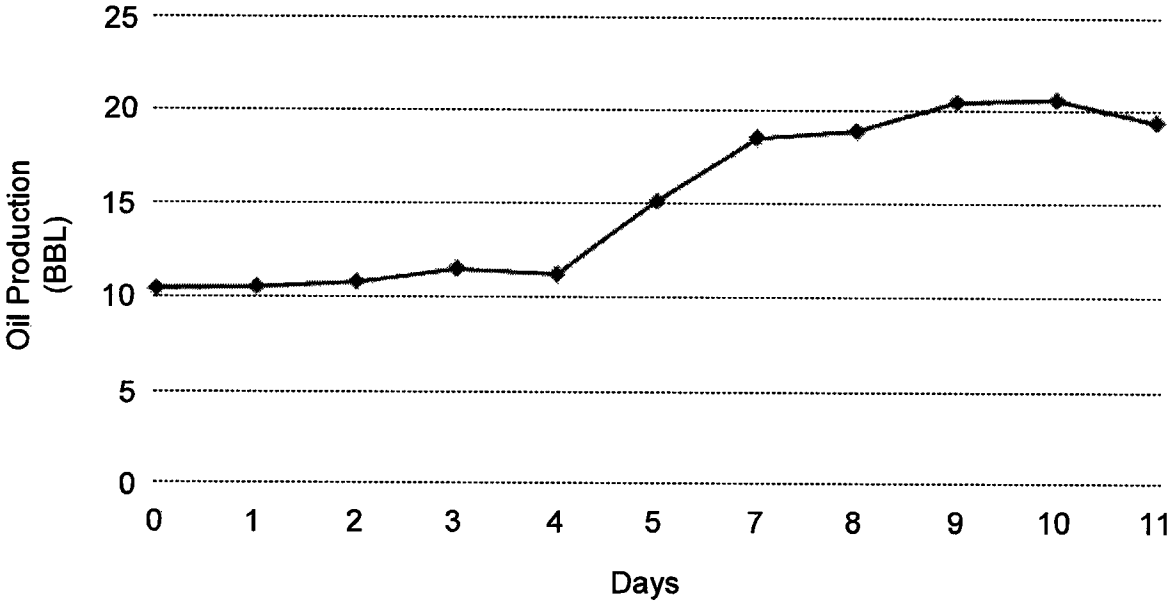
FIG. 5 is a graph illustrating oil production in barrels plotted against time for the well of FIG. 4.

FIG. 5 is a plot of the measured daily production of the same well of FIG. 4, both before and after commencing the pressure cycling method described above. Point [to be edited] in FIG. 5 indicates the day corresponding to the 24-hour period depicted in FIG. 4. It can be clearly seen that the daily production rose to almost double the pre-pressure cycling production, from about 11 to 20 barrels.

In one embodiment, the casing pressure control valve 15 is operated manually by a human operator. However, the casing pressure may be manipulated automatically, for example through automated operation of the valve 15 using a timer, or using a microprocessor. The microprocessor may be programmed with a schedule for opening and closing the valve 15 based on experimental results and downhole card computations, as in the example provided above. The microprocessor may also be in communication with a casing pressure sensor device and/or other sensors, measurements from which are used by the microprocessor to trigger the opening and closing of the valve 15. For example, the microprocessor may be configured to trigger valve opening and/or closing upon detecting specified pressure levels in the casing, tubing, or upon detecting other threshold conditions at surface components.

One of such measurements could be, for example, an acoustic measurement of the fluid level in the casing annulus using an acoustic gun 17 as mentioned above. The valve 15 would be closed at time $t_1$ when the fluid level exceeds a certain level, and it would be opened at time $t_2$ when the fluid level drops to a certain level near the pump intake. The fluid level could be continuously measured in order to directly control the opening and closing of the valve 15. Alternatively, the fluid level could be measured during just one cycle to determine two parameters for controlling the valve: a casing pressure at which the valve 15 should be opened, and the period of time ($t_3$ to $t_1$) it should remain open. These two parameters could be used for controlling the valve for a number of cycles. Since operating conditions of the well may change over time, the measurements would be repeated during a later cycle, and the two parameters adjusted accordingly. Another way to determine the casing pressure at which the valve 15 should be opened is to analyze the rate of change of casing pressure over time. Once the valve 15 is closed, the casing pressure increase will slow over time, as illustrated in FIG. 3. Once the rate of increase of the casing pressure drops below a certain threshold, the casing pressure measurement at that point may be used as the trigger for opening the valve 15.

Accordingly, there is provided a method of controlling fluid production from a gaseous well equipped with an artificial lift pumping system, the pumping system including a downhole pump in a wellbore of said well, the method comprising cyclically increasing and decreasing gas pressure in the casing annulus of the wellbore while pumping fluid from the wellbore.

In one aspect, the downhole pump is positioned above a producing interval of the wellbore.

In another aspect, the gaseous well is a horizontal well.

In still another aspect, the gaseous well is a gaseous hydrocarbon well.

In yet another aspect, the cyclical increasing and decreasing of gas pressure is obtained through opening and closing a valve in fluid communication with the casing annulus.

In still a further aspect, the opening and closing is carried out manually. Alternatively, the opening and closing can be carried out automatically, and optionally can be microprocessor-controlled.

In another aspect, cyclically increasing the gas pressure within the casing annulus comprises starting said increasing when the casing pressure is determined to be substantially stable.

Still further, cyclically decreasing the gas pressure within the casing annulus may comprise starting said decreasing when a fluid level in the casing annulus is determined to be substantially close to an intake of the downhole pump.

There is also provided an artificial lift pumping system including a downhole pump in a wellbore of a gaseous well, adapted to carry out the methods and any one or more of the variants described above.

There is also provided, in an artificial lift pumping system for a fluid-producing well, the pumping system including a downhole pump connected to a rod string, the rod string provided within a tubing disposed within a casing, the casing being provided within a wellbore and being in fluid communication with a reservoir, a casing annulus thus being defined by the tubing within the casing, a producing bottomhole pressure (PBHP) being defined by a differential between a pressure in the reservoir and a pressure in the casing at a point of said fluid communication with the reservoir, the improvement of: the pumping system being adapted to cyclically decrease and increase pressure in the casing annulus so as to cyclically decrease the PBHP in response to the decrease in the casing annulus pressure and permit the PBHP to increase in response to the increase in casing annulus pressure, whereby production of fluid from the reservoir is increased during the cyclical decrease in casing annulus pressure and production of fluid from the downhole pump is increased during the cyclical increase in casing annulus pressure.

There is also provided, in an artificial lift pumping system in a gaseous well, the pumping system including a downhole pump connected to a rod string, the rod string provided within a tubing disposed within a casing, the casing being provided within a wellbore and being in fluid communication with a reservoir, a casing annulus thus being defined by the tubing within the casing, a producing bottom-hole pressure (PBHP) being defined by a differential between a pressure in the reservoir and a pressure in the casing at a point of said fluid communication with the reservoir, a method of mitigating gas interference due to production of foam in the casing surrounding the downhole pump by forcing liquid from the foam comprising cyclically increasing and decreasing casing annulus pressure above the foam.

It will be apparent to those skilled in the art that various embodiments, having been disclosed herein, may be practised without some or all of the specific details. Known components have not been described in detail to avoid unnecessarily obscuring the present methods and processes. It is to be understood that although many characteristics and advantages of the embodiments are set forth in this description, together with details of the structure and function of the embodiments, this disclosure is illustrative only and is not intended to be limiting. Other embodiments may be constructed or implemented that nevertheless employ the principles and features of the present disclosure.

The invention claimed is:

1. A method of controlling fluid production from a gaseous well equipped with an artificial lift pumping system, the pumping system including a downhole pump in a wellbore of said well, the method comprising:

cyclically increasing and decreasing gas pressure in the casing annulus of the wellbore while pumping fluid from the wellbore, wherein increasing gas pressure in the casing annulus reduces a volume of foam at a downhole pump intake and liquid in the foam is forced toward the downhole pump intake, and decreasing gas pressure in the casing annulus decreases the gas pressure to a level permitting foam to develop at the downhole pump intake.

2. The method of claim 1, wherein the downhole pump is positioned above a producing interval of the wellbore.

3. The method of claim 1, wherein the gaseous well is a horizontal well.

4. The method of claim 1, wherein the gaseous well is a gaseous hydrocarbon well.

5. The method of claim 1, wherein the cyclical increasing and decreasing of gas pressure is obtained through closing and opening a valve in fluid communication with the casing annulus.

6. The method of claim 5, wherein said closing and opening are carried out manually.

7. The method of claim 5, wherein said closing and opening are carried out automatically.

8. The method of claim 5, wherein the valve is a surface-located valve.

9. The method of claim 1, wherein cyclically increasing the gas pressure within the casing annulus comprises starting said increasing when the casing pressure is determined to be substantially stable.

10. The method of claim 9, wherein cyclically decreasing the gas pressure within the casing annulus comprises starting said decreasing when a fluid level in the casing annulus is determined to be substantially close to an intake of the downhole pump.

11. The method of claim 1, wherein the artificial lift pumping system does not include a gas separator.

12. In an artificial lift pumping system for a fluid-producing well, the pumping system including a downhole pump connected to a rod string, the rod string provided within a tubing disposed within a casing, the casing being provided within a wellbore and being in fluid communication with a reservoir, a casing annulus thus being defined by the tubing within the casing, a producing bottom-hole pressure (PBHP) being defined by a differential between a pressure in the reservoir and a pressure in the casing at a point of said fluid communication with the reservoir, a method of operating the pumping system comprising:

while pumping fluid from the wellbore, increasing pressure in the casing annulus by closing a valve in fluid communication with the casing annulus such that a volume of foam proximate to an intake of the downhole pump is reduced; and decreasing pressure in the casing annulus by opening the valve, the increasing and decreasing of the casing annulus pressure being carried in out a substantially cyclic pattern, the PBHB thereby cyclically increasing and decreasing in response to the increasing and decreasing of the casing annulus pressure, whereby production of fluid from the reservoir is increased during the decrease in casing annulus pressure and production of fluid from the downhole pump is increased during the increase in casing annulus pressure.

13. The method of claim 12, wherein the fluid-producing well is a horizontal well.

14. The method of claim 12, wherein the fluid-producing well is a gaseous hydrocarbon well.

15. The method of claim 12, wherein the valve comprises a casing pressure control valve at a top of the casing annulus.

16. The method of claim 12, wherein increasing the pressure in the casing annulus comprises initiating closing of the valve when the casing annulus pressure is determined to be substantially stable.

17. The method of claim 16, wherein decreasing the pressure in the casing annulus comprises initiating opening of the valve when a fluid level in the casing annulus is determined to be substantially close to an intake of the downhole pump.

18. In an artificial lift pumping system in a gaseous well, the pumping system including a downhole pump connected to a rod string, the rod string provided within a tubing disposed within a casing, the casing being provided within a wellbore and being in fluid communication with a reservoir, a casing annulus thus being defined by the tubing within the casing, a producing bottom-hole pressure (PBHP) being defined by a differential between a pressure in the reservoir and a pressure in the casing at a point of said fluid communication with the reservoir, a method of mitigating gas interference due to production of foam in the casing surrounding the downhole pump, the method comprising:

while pumping fluid from the wellbore, increasing pressure in the casing annulus above the foam by closing a valve in fluid communication with the casing annulus such that a volume of the foam is reduced and liquid in the foam is forced into the downhole pump; and decreasing pressure in the casing annulus by opening the valve, the increasing and decreasing of the casing annulus pressure being carried in out a substantially cyclic pattern.

19. The method of claim 18, wherein the gaseous well is a horizontal well.

20. The method of claim 18, wherein the valve comprises a casing pressure control valve at a top of the casing annulus.

21. The method of claim 20, wherein increasing the pressure in the casing annulus comprises initiating closing of the valve when the casing annulus pressure is determined to be substantially stable, and decreasing the pressure in the casing annulus comprises initiating opening of the valve when a fluid level in the casing annulus is determined to be substantially close to an intake of the downhole pump.

* * * * *